US009907417B2

(12) United States Patent
Brown, III

(10) Patent No.: US 9,907,417 B2
(45) Date of Patent: Mar. 6, 2018

(54) DISPLAY FRAME FOR COLLECTABLES

(71) Applicant: James Thomas Brown, III, Knoxville, TN (US)

(72) Inventor: James Thomas Brown, III, Knoxville, TN (US)

( * ) Notice: Subject to any disclaimer, the term of this patent is extended or adjusted under 35 U.S.C. 154(b) by 0 days.

(21) Appl. No.: 14/625,620

(22) Filed: Feb. 18, 2015

(65) Prior Publication Data

US 2015/0230633 A1 Aug. 20, 2015

Related U.S. Application Data

(60) Provisional application No. 61/941,608, filed on Feb. 19, 2014.

(51) Int. Cl.
*A47G 1/06* (2006.01)
*A47G 1/12* (2006.01)

(52) U.S. Cl.
CPC ..... *A47G 1/12* (2013.01); *A47G 2001/0672* (2013.01)

(58) Field of Classification Search
CPC ..... A47G 1/12
USPC ..... 40/734, 781, 800; 206/776, 779
See application file for complete search history.

(56) References Cited

U.S. PATENT DOCUMENTS 1,448,664 A * 3/1923 Hull ..... G09F 7/22 211/169
3,039,217 A * 6/1962 Stefanakis ..... A47G 1/00 312/224
4,258,488 A 3/1981 Schiebein
5,249,683 A 10/1993 Baucom
5,277,949 A 1/1994 Green
5,584,135 A * 12/1996 Hosker ..... B44C 5/0446 40/768

(Continued)

FOREIGN PATENT DOCUMENTS

WO WO2000057389 9/2000
WO WO2011028537 3/2011
WO WO2012142412 10/2012

OTHER PUBLICATIONS

International Search Report and Written Opinion for PCT application PCT/US2015/016449 filed Feb. 18, 2015, ISR/WO dated May 20, 2015.

*Primary Examiner* — Joanne Silbermann
(74) *Attorney, Agent, or Firm* — Knox Patents; Kenneth C. Spafford

(57) ABSTRACT

Apparatus for displaying packaged collectables in a supportive and protective frame. A rear frame member is secured inside a front frame member with a latch. The front frame member has sidewalls that enclose the rear frame member. In one embodiment the latch relies upon magnetic coupling between the front and rear frame members. In another embodiment the latch includes a tab engaging a slot and at least one detent capturing the rear frame member inside the sidewalls of the front frame member. The front frame member has an opening to allow the protrusion of a blister if the collectable has a blister package. The rear frame member has a transparent pane or portion. The collectable is visible from the front and back of the frame. The front and rear frame members are separable by manipulating the rear frame member through at least one notch in the front frame member.

12 Claims, 10 Drawing Sheets

(56) References Cited

U.S. PATENT DOCUMENTS

| | | | | |
|---|---|---|---|---|
| 5,730,291 | A * | 3/1998 | Smallwood | G09F 3/20 206/455 |
| 5,971,826 | A | 10/1999 | Delzompo et al. | |
| 6,070,721 | A | 6/2000 | Levintan | |
| 6,298,593 | B1 * | 10/2001 | Vilims | A47G 1/0605 24/563 |
| 6,442,879 | B1 * | 9/2002 | Callendar | A47G 1/0616 206/486 |
| 6,554,132 | B2 | 4/2003 | Lau | |
| 7,069,682 | B2 | 7/2006 | Gatt et al. | |
| 7,591,097 | B2 | 9/2009 | Alman et al. | |
| 8,595,969 | B1 | 12/2013 | Whellis et al. | |
| 2007/0087651 | A1 | 4/2007 | Ali | |
| 2008/0120883 | A1 | 5/2008 | Haase et al. | |
| 2009/0100732 | A1 | 4/2009 | Seidler | |
| 2009/0121109 | A1 | 5/2009 | Kinmont et al. | |
| 2011/0131855 | A1 | 6/2011 | Heeps | |
| 2012/0285060 | A1 | 11/2012 | Gross et al. | |

* cited by examiner

DISPLAY FRAME FOR COLLECTABLES

CROSS-REFERENCE TO RELATED APPLICATIONS

This application claims the benefit of U.S. Provisional Application No. 61/941,608, filed Feb. 19, 2014.

STATEMENT REGARDING FEDERALLY SPONSORED RESEARCH OR DEVELOPMENT

Not Applicable

BACKGROUND

1. Field of Invention

This invention pertains to display cases for collectables. More particularly, this invention pertains to frames and cases that display items that remain in their original packaging.

2. Description of the Related Art

Frames are widely available in a wide assortment of shapes, sizes, styles, and colors for displaying pictures, paintings, drawings, and works of art. Picture frames, for example, are available and generally have a rectangular configuration with an open or transparent front through which the picture is visible and protected. Such frames are suited for displaying flat, planar objects, such as a painting or photograph. Many such picture frames allow viewing only from the front of the frame and are not intended to be picked up and handled so that the picture can be viewed from the back side.

Various frames and display devices are known. For example, United States Patent Application Number 2009/0100732, naming inventor Stewart Seidler, published on Apr. 23, 2009, and titled, "Magnetic display device," discloses a display case having external magnets for combining multiple frames into a modular display device album. United States Patent Application Number 2012/0285060, naming inventor Raoul Gross, published on Nov. 15, 2012, and titled, "Picture frames," discloses picture frames with flexible borders that can be coupled together in a variety of configurations. Like the Seidler patent application, the Gross patent application discloses magnets to couple one picture frame to another.

United States Patent Application Number 2009/0121109, naming inventor Richard C. Kinmont, published May 14, 2009, and titled, "Display stand for action figure," discloses one method for displaying an action figure or collectable on a lighted, table-top stand. The collectable is removed from its packaging for display, which subjects the collectable to damage and soiling from handling.

United States Patent Application Number 2007/0087651, naming inventor Aneel Ali, published Apr. 19, 2007, and titled, "Action figure stands," also discloses a way to display action figures or collectables. The stand described in the Ali application has a support that attaches to the figure and to the stand, thereby securing the figure to the stand and making it more stable. As with the above application, the collectable is removed from its packaging for display, which subjects the collectable to damage and soiling from handling.

U.S. Pat. No. 4,258,488, issued to Schienbein on Mar. 31, 1981, and titled, "Phonograph record album display frame," discloses a frame with an opening that receives an album cover. The album cover is positioned inside the opening with the bottom of the album cover resting in a groove or between bosses in the bottom of the opening with the album cover tilted back and resting against an inside surface of the frame.

The display frame allows only the front, exposed surface of the album cover to be viewed without removing the album cover from the display frame.

Another type of display device for a phonograph album is disclosed in U.S. Pat. No. 6,070,721, issued to Levitan on Jun. 6, 2000, and titled "Display case for phonograph album and record." The '721 patent discloses a shallow rectangular open topped base tray with a hinged transparent cover that latches in position. The tray includes a support post that secures the record outside the album cover such that a portion of the record is visible along with the album cover.

BRIEF SUMMARY

According to one embodiment of the present invention, a display frame for collectables is provided. Collectables are objects that have value to collectors. Collectables include such items as action figures; movie, sports and game memorabilia; music albums; and posters. These collectables are often kept in their original merchandising packaging. It is desirable to display such collectables in a manner so as to avoid damaging the packaging. A common type of merchandise package is a blister package, which has a planar portion with a blister or bubble projecting from the planar portion. The product is contained in the blister. The planar portion is typically cardboard or paperboard with printing. The blister has a flange extending from the sides with the flange adhered to the planar portion. A similar type of packaging is clamshell packaging, which is a plastic package that is available in various configurations. Generally clamshell packaging has a peripheral edge that is substantially planar.

The display frame includes a front frame member and a rear frame member with the collectable sandwiched between a front pane and a rear pane secured by the front and rear frame members. For those collectables that have a blister on the front of the packaging, the blister extends through an opening in the front pane. In this way the collectable is supported and protected to prevent the packaging from becoming distorted and/or damaged while still allowing the collectable to be visible for display.

The front frame member includes a front surface and four side surfaces or sidewalls that extend rearward from the front surface. In the front surface is an opening. A front pane is positioned inside the front frame member proximate the opening in the front surface. A resilient material extends from a portion of the front pane opposite the front surface of the front frame member.

The rear frame member includes a rear surface and four side surfaces. In the rear surface is an opening. A rear pane is positioned proximate the front surface of the rear frame member proximate the opening in the rear surface. A resilient material extends from a portion of the rear pane opposite the rear surface of the rear frame member. In various embodiments a frame hanger is attached to the rear surface for hanging the display frame to a wall. In one such embodiment the rear surface of the rear frame member includes standoffs or spacers that space the rear surface and the back edge of the front frame member sidewalls away from the wall.

The rear frame member fits inside the front frame member with the rear surface of the rear frame member visible from the back of the front frame member. A latch mechanism secures the front frame member to the rear frame member. The latch mechanism includes a plurality of magnets that are attached to the inside surface of the front frame member and a material responsive to the magnets that is attached to the front surface of the rear frame member at positions corresponding to the magnet locations. In this way the front and rear frame members are secured or latched together. In another embodiment, the magnets are attached to the rear frame member and the material responsive to the magnets is attached to the rear surface of the front frame member at positions corresponding to the magnet locations.

The front frame member includes at least one outside notch that corresponds with at least one inside notch or edge in the rear frame member. The notches allow a user to separate the front frame member from the rear frame member by manipulating an edge of the rear frame member through the outside notch.

For collectables that are in blister-type packaging, the front pane includes a cutout or opening sized and configured to allow the blister to extend through the front pane. In another embodiment the front pane is non-planar and extends over the blister, thereby protecting the collectable. The planar portion of the collectable packaging is sandwiched between the front and rear panes. For collectables that are completely planar the collectable is entirely enclosed by the display frame, thereby protecting the collectable from fingerprints and other damage from handling when the collectable is viewed.

In another embodiment the display frame includes a front frame member and a rear frame member wherein the rear frame member is a planar sheet that fits inside said front frame member and rests on frame support ribs. The rear frame member and the front frame member latch together, securing the collectable therebetween. The latch mechanism includes a tab protruding from the rear frame member and a slot in a sidewall of the front frame member configured to receive the tab. In one embodiment the latch mechanism includes detents on the inside sidewall surface of the front frame member that engage the edge of the rear frame member, thereby securing the rear frame member to the front frame member. In another embodiment the latch mechanism includes a magnetic assembly that secures the rear frame member to the front frame member by magnetic attraction. A notch in the sidewall of the front frame member opposite the slot for the tab allows a user to apply pressure to the edge of the rear frame exposed by the notch, thereby unlatching the members by prying the rear frame member from the front frame member.

The rear frame member is offset inside the front frame member with spacers attached to the rear, outer surface of the rear frame member that extend beyond the rearmost portion of the front frame member. In this way the spacers support the rear frame member when the rear frame member is positioned on a flat surface, such as a table top. The collectable is then placed on the rear frame member and the front frame member is placed over the collectable and secured to the rear frame member by pushing the front frame member against the flat surface.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for displaying a collectable 108 is disclosed. The display frame is indicated generally as 100, with particular embodiments and variations shown in the figures and described below having an alphabetic suffix, for example, 100-A and 100-B.

Figure 1:
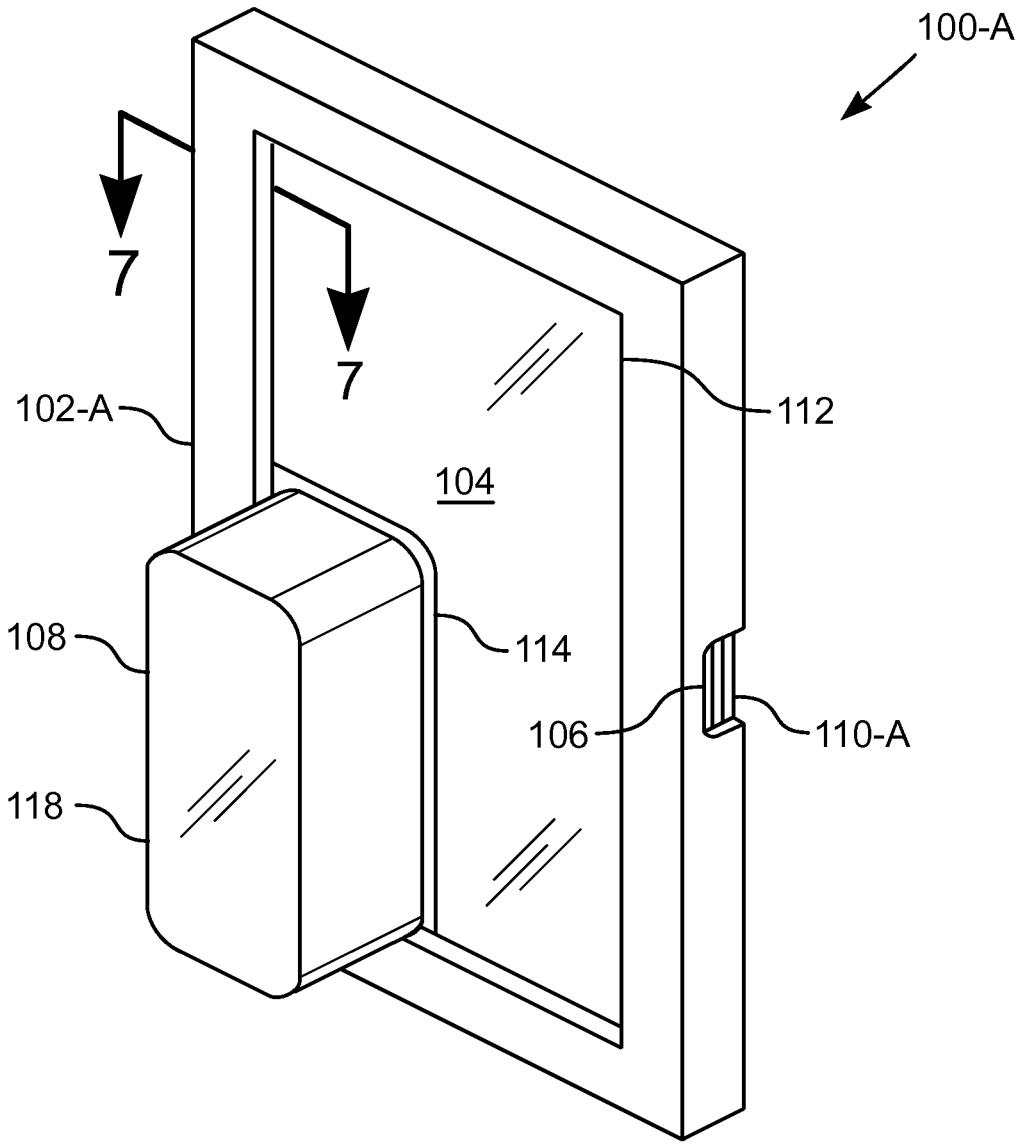
FIG. 1 is an isometric view of one embodiment of a display frame.
Figure 2:
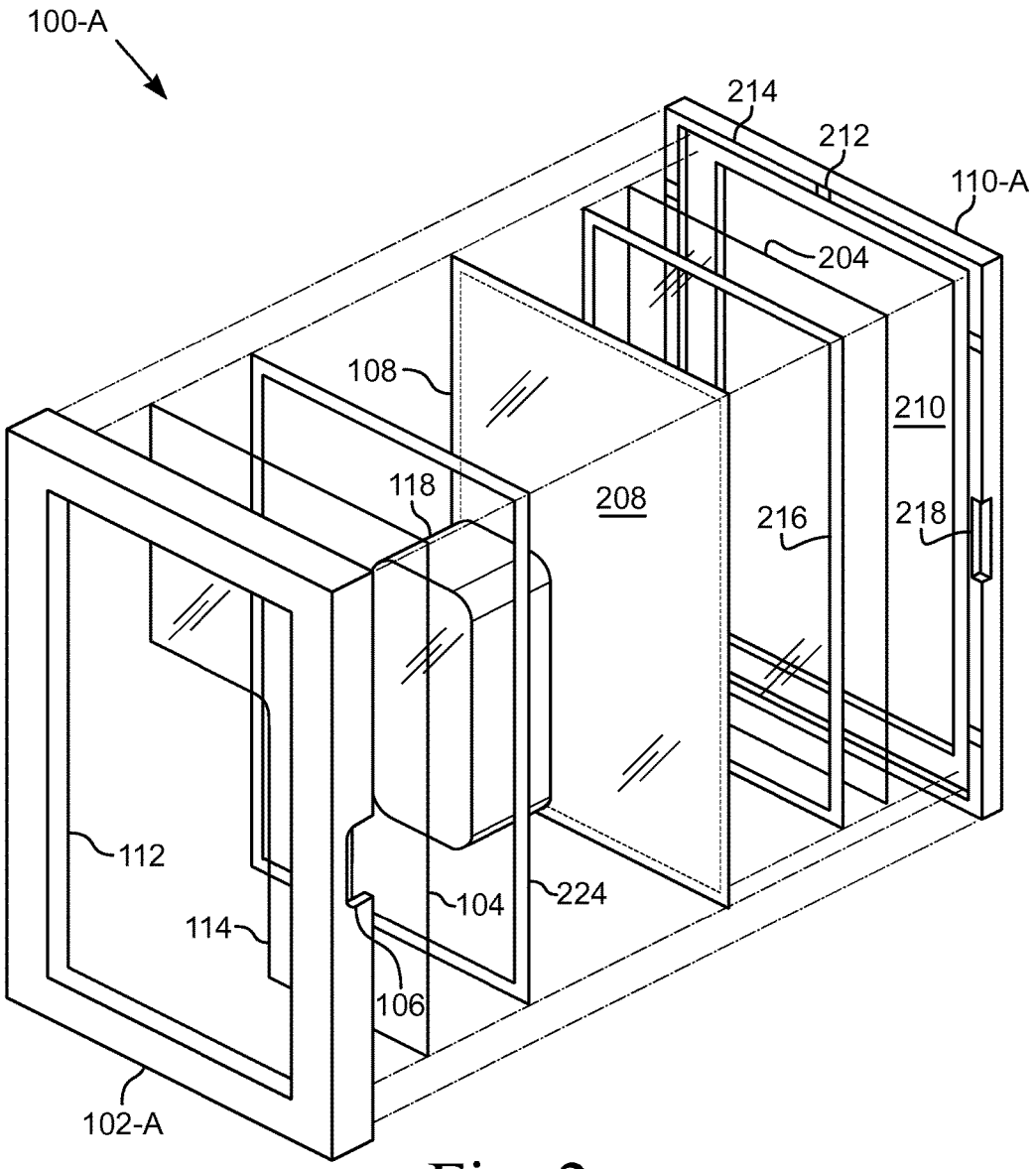
FIG. 2 is an exploded diagram showing the display frame of FIG. 1.

FIG. 1 illustrates an isometric view of one embodiment of a display frame 100-A. FIG. 2 illustrates an exploded diagram showing the display frame 100-A of FIG. 1. The collectable 108 in the illustrated embodiment has a blister 118 and a planar portion 208. The blister 118 is located at the lower left corner of the collectable 108. Other collectables 108 have various sized blisters 118 located at various positions on the planar portion 208. Some collectables 108, such as albums and posters, have only a planar portion 208 with no blister 118.

The display frame 100-A includes a front frame member 102-A and a rear frame member 110-A. The front frame member 102-A is a rectangular structure that includes a front pane 104. The rear frame member 110-A is a rectangular structure that includes a rear pane 204. Between the front and rear panes 104, 204 is the collectable 108.

The front frame member includes an outside notch 106 that aligns with an inside notch 218 on the rear frame member. The pair of notches 106, 218 allow the front frame member 102-A to be easily separated from the rear frame member 110-A. By positioning the notches 106, 218 on the side the front frame member can be easily removed without interference with or scraping the blister 118.

The front pane 104 fits inside the front frame member 102-A. The front pane 104 is a clear or transparent sheet that allows the front of the collectable 108 to be visible from the front of the display frame 100-A. The front pane 104, in the illustrated embodiment of the display frame 100-A, includes a front opening 114 through which the blister 118 fits. Because of the variety of collectables 108 and the varied positioning of blisters 118, the opening 114 in the front pane 104 varies to correspond with the position of the blister 118 on the collectable 108 desired to be displayed by the frame 100-A. The edges of the front opening 114 extend to the sides of the blister 118, but do not contact the sides of the blister 118. The front pane 104 overlaps the portion of the blister 118 that is attached to the planar portion 208 of the packaging of the collectable 108. In this way the front pane 104 provides support and protection of the attachment of the blister 118 to the planar portion 208, thereby minimizing the risk of the blister 118 being pulled off or separating from the planar portion 208. In another embodiment the front pane 104 is non-planar, but has a shape that conforms to the collectable 108. In such an embodiment a portion of the front pane 104 extends away from the front frame member 102-A such that the collectable 108 is enclosed by the front pane 104.

The rear pane 204 is a clear or transparent sheet that fits inside the rear frame member 110-A. The rear pane 204 is sandwiched between a resilient material 216 and the rear frame member 110-A. The rear frame member 110-A includes a rear opening 210 that allows the rear of the collectable 108 to be visible from the rear of the display frame 100-A. The front periphery of the rear frame member 110-A includes a plurality of spaced metal objects 212 that are responsive to a magnetic field. The intervening space between the spaced metal objects 212 includes a resilient material 214.

Figure 3:
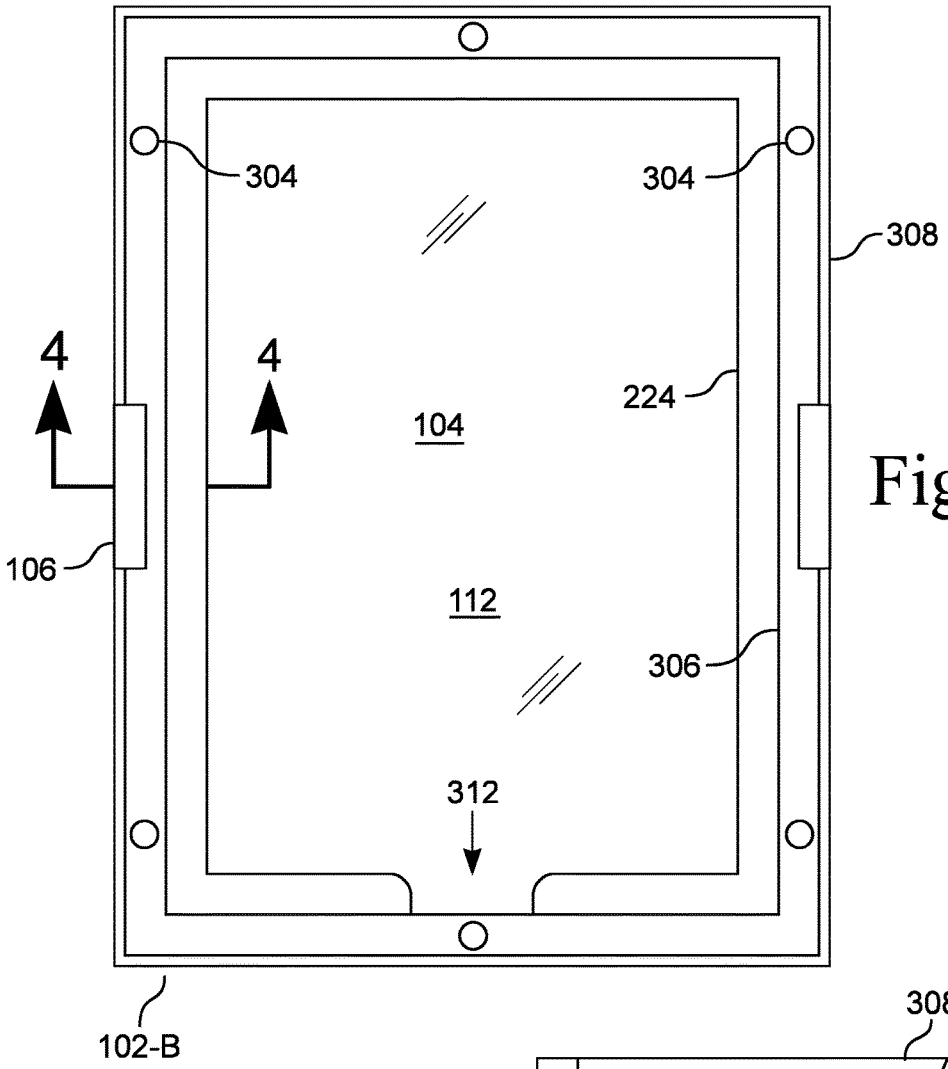
FIG. 3 is a plan view of the rear of another embodiment of a front frame member.
Figure 4:
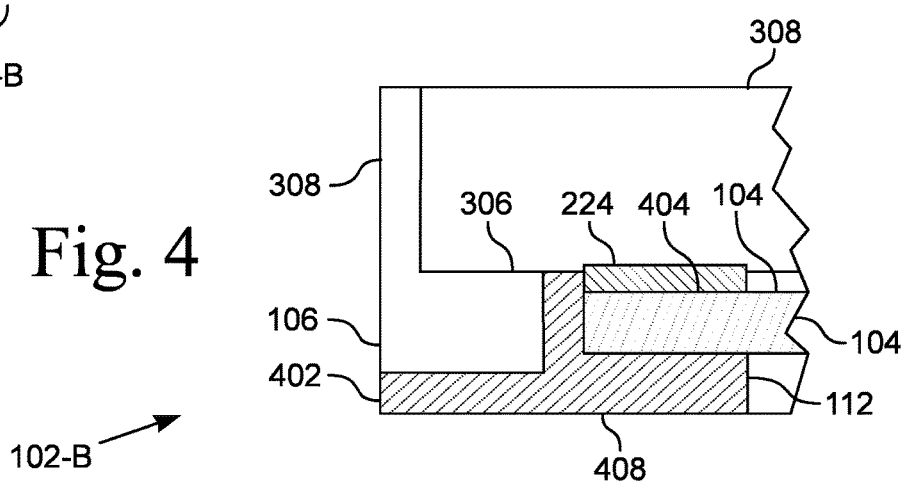
FIG. 4 is a partial cross-sectional view of one embodiment of an outside notch in the front frame member.

FIG. 3 illustrates a plan view of the rear of another embodiment of a front frame member 102-B. FIG. 4 illustrates a partial cross-sectional view of one embodiment of an outside notch 106 in the front frame member 102. The front frame member 102-B includes a front surface 408. Extending from the front surface 408 rearward are four sidewalls 308 that define the periphery of the front frame member 102-B. The front surface 408 presents a frame face between the sidewalls 308 and the edge of the front opening 112. The display frame 100 can be grasped and held by a person by holding the frame 100 between the front surface 408 and the rearmost edge of the sidewalls 308. The edge of the front surface 408 that forms the front opening 112 defines a plane. In the illustrated embodiment the front surface 408 is a planar face. Behind the front surface 408 is a recess 404 that surrounds the front opening 112. The peripheral edge of the front pane 104 fits into the recess 404, where it is secured to the front frame member 102-B such as with an adhesive or mechanical clip or fastener. A resilient material 224 is attached to the rear surface of the peripheral edge of the front pane 104 such as with an adhesive. The rear surface of the resilient material 224 extends slightly rearward past the rear inside surface 306 of the front frame member 102-B.

The display frame 100 includes a latching mechanism. In the illustrated embodiment the latching mechanism includes a plurality of magnets 304 are spaced around the rear surface 306 of the front frame member 102-B. In the illustrated embodiment the magnets 304 are positioned in a recess with the outer surface of the magnets 304 flush with the rear surface 306 of the front frame member 102-B. The magnets 304 are positioned to engage the metal objects 212 on the rear frame member 110-A. In this way when the front and rear frame members 102-B, 110-A are positioned proximately they are held together, or latched, by the magnetic force between the magnets 304 and the metal objects 212. In order to maximize the strength of the magnetic attraction the magnets 304, in one embodiment, are rare earth magnets.

In another embodiment, the magnets 304 are affixed to the rear frame member 110-A and the metal objects 212 are attached to the front frame member 102-A, 102-B. In yet another embodiment, the rear frame member 110-A has magnets instead of the metal objects 212, with the magnets having an opposite polarity as the magnets 304 in the front frame member 102-A, 102-B. In each of these ways the front and rear frame members 102-A, 102-B, 110-A are secured together by magnetic force. Those skilled in the art will recognize that the number of magnets 304 and metal objects 212 will vary based on the size of the display frame 100 and the strength of the magnets 304 without departing from the spirit and scope of the present invention.

The outside notch 106 defines a lip 402 adjacent the front surface 408 of the front frame member 102. A force applied normal to the rear surface of the lip 402 relative to the rear frame member 110 acts against the magnetic force holding the magnets 304 to the metal objects 212.

The illustrated embodiment of the front frame member 102-B includes a blister notch 312 positioned in the bottom edge of the front opening 212. The blister notch 312 is provided to provide clearance for a foot 802 extending from the bottom of the blister 118-A.

Figure 5:
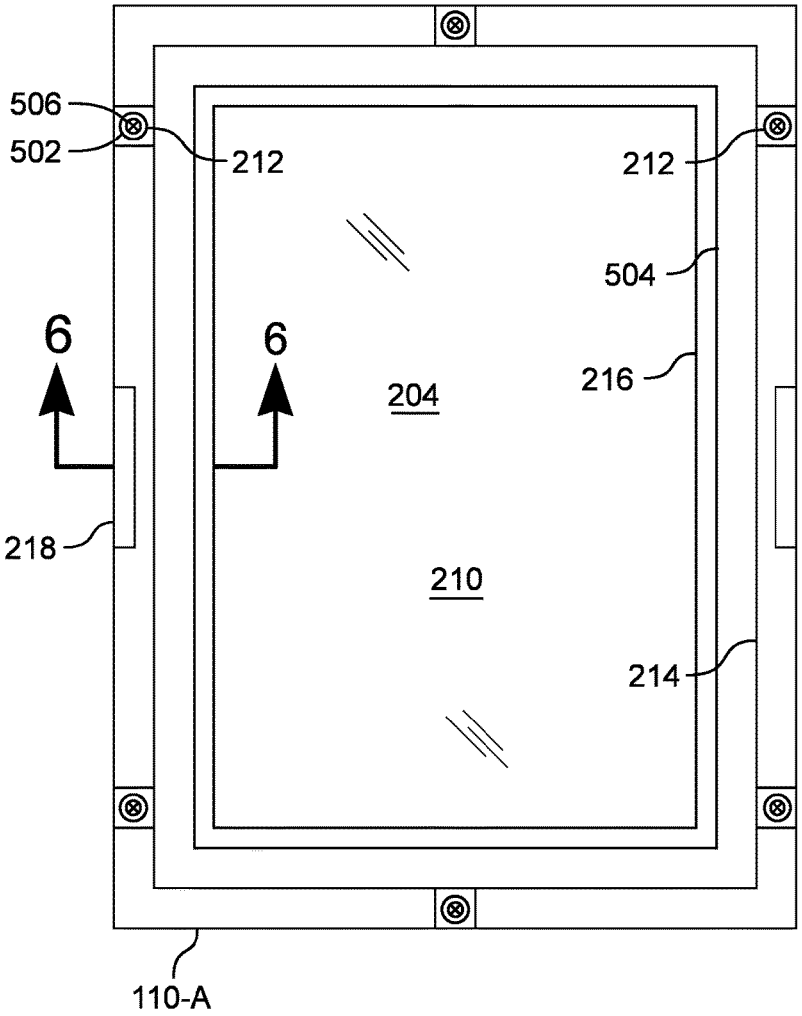
FIG. 5 is a plan view of the front of one embodiment of a rear frame member.
Figure 6:
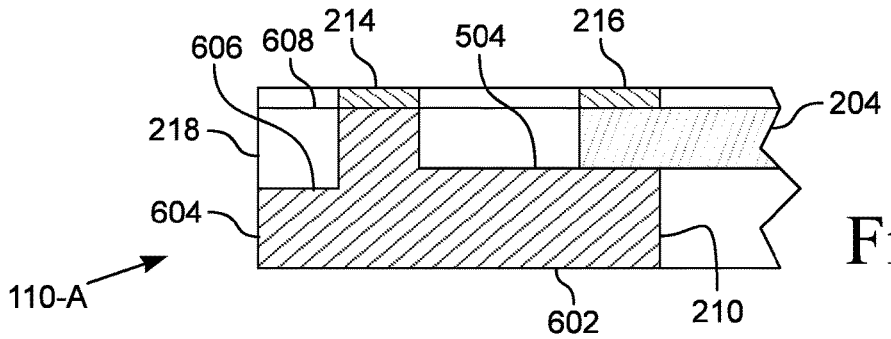
FIG. 6 is a partial cross-sectional view of one embodiment of an inside notch in the rear frame member.

FIG. 5 illustrates a plan view of the front of one embodiment of a rear frame member 110-A. FIG. 6 illustrates a partial cross-sectional view of one embodiment of an inside notch 218 in the rear frame member 110-A. The rear frame member 110-A includes a rear surface 602. The rear frame member 110-A is dimensioned to fit between the sidewalls 308 of the front frame member 102-A, 102-B. Behind the rear surface 602 is a recess 504 that surrounds the rear opening 210. The peripheral edge of the rear pane 204 fits into the recess 504, where it is secured to the rear frame member 110-A. A resilient material 216 is attached to the front surface of the peripheral edge of the rear pane 204. Opposite the rear surface 602 of the rear frame member 110-A is a front surface 608 of the rear frame member 110-A. A resilient material 214 is attached to the front surface 608 of the rear frame member 110-A. The front surfaces of the resilient materials 216, 214 are substantially even.

A plurality of metal objects 212 are spaced around the front surface 608 of the rear frame member 110-A. In the illustrated embodiment the metal objects 212 include a washer 502 secured with a fastener 506, such as a screw, to the front surface 608 of the rear frame member 110-A. For example, the washer 502 is a #8 washer and the fastener 506 is a #4 zinc plated screw. The fastener 506 is countersunk with respect to the washer 502 so that a flat surface is presented for engagement with the corresponding magnet 304 attached to the front frame member 102-A, 102-B. The resilient material 214 extends from the front surface 608 of the rear frame member 110-A the same distance or slightly greater than the distance that the metal object 212 extends from the front surface 608. In this way the resilient material 214 provides a seal and cushion between the front surface 608 of the rear frame member 110-A and the rear surface 408 of the front frame member 102-A, 102-B.

The inside notch 218 defines a lip 604 adjacent the rear surface 602 of the rear frame member 110-A. A force applied normal to the front surface of the lip 606 relative to the front frame member 102-A, 102-B acts against the magnetic force holding the magnets 304 to the metal objects 212.

Figure 7:
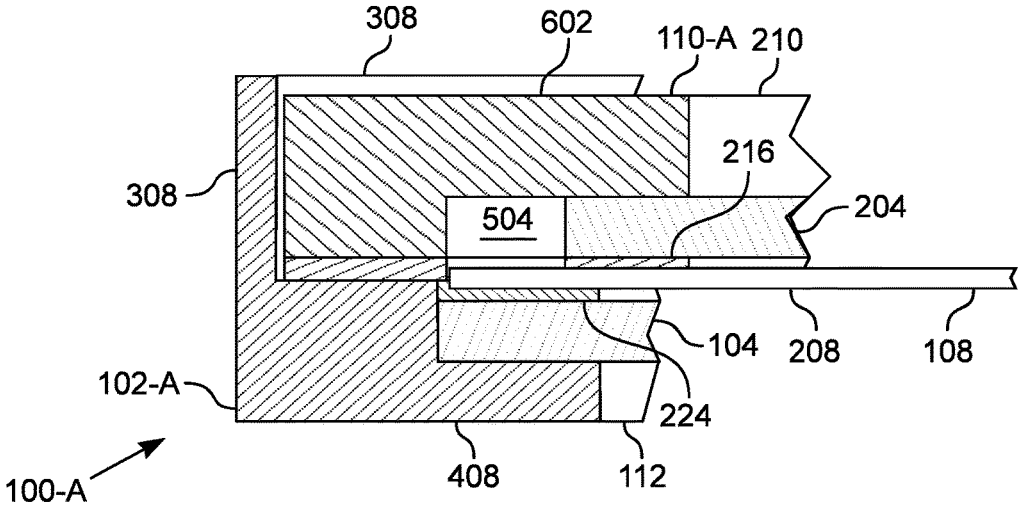
FIG. 7 is a partial cross-sectional view of the collectable sandwiched between the front and rear frame members.

FIG. 7 illustrates a partial cross-sectional view of the collectable 108 sandwiched between the front and rear frame members 102-A, 110-A of a display frame 100-A. The planar portion 208 of the collectable 108 extends around the periphery of the collectable 108. The outer edge of the planar portion 208 is sandwiched between the resilient material 224 on the front pane 104 and the resilient material 216 on the rear pane 204. In this way the collectable 108 is sandwiched between the front and rear panes 104, 204 without the panes 104, 204 applying clamping pressure to the planar portion 208 of the collectable 108.

In one embodiment, the resilient material 214, 216, 224 is a utility fabric rubber sheet. The resilient material 214, 216, 224 is compressible and does not react nor stain the surface of the collectable 108 that it contacts. In one such embodiment the resilient material 214, 216, 224 is adhesively adhered to the rear frame member 110 and the front and rear panes 104, 204. In the illustrated embodiment the thickness of the resilient material 214, 216, 224 is substantially the same as the distance the metal objects 212 extend from the front surface 608 of the rear frame member 110 with the magnets 304 mounted flush with the rear surface 306 of the front frame member 102. In one such embodiment the resilient material 214, 216, 224 is approximately 0.034 inches thick.

FIG. 7 shows the rear surface 602 of the rear frame member 110-A recessed between the sidewalls 308 of the front frame member 102. In various embodiments the rear surface 602 of the rear frame member 100 is either recessed between or flush with the outer edge of the sidewalls 308 of the front frame member 102.

In the illustrated embodiment the rear opening 210 has a smaller width and height relative to the front opening 112. In another embodiment the front and rear openings 112, 210 are the same size. In the illustrated embodiment the resilient material 216, 224 on either side of the planar surface 208 overlaps slightly. The space remaining in the recess 504 is available for those collectables 108 that have a lip or projection at the edge of the planar surface 208.

In one embodiment the display frame 100 does not include the front and/or rear panes 104, 204. In such an embodiment the collectable 108 is still supported by the resilient material 216, 224 but without the panes 104, 204 adjacent the planar portion 208 of the collectable 108. In this way the display frame 100 is configured to receive a wide variety of collectables 108 without requiring a front pane 104 with a front opening 114 specially configured to fit the blister 118.

In another embodiment the front frame member 102 does not have the sidewalls 308. Instead, the front and rear frame members 102, 110 have the same outside dimensions so that the sides of the front and rear frame members 102, 110 are flush.

Figure 8:
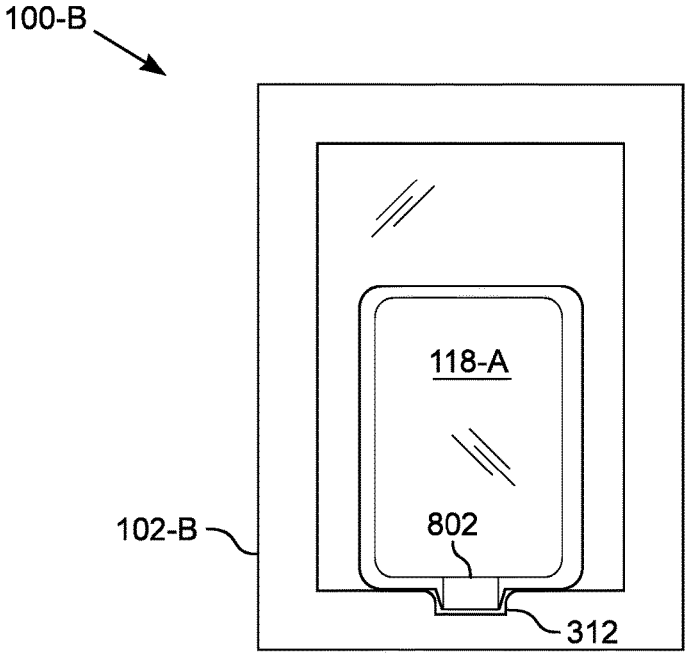
FIG. 8 is a plan view of the front of a second embodiment of a display frame.

FIG. 8 illustrates a plan view of the front of a second embodiment of a display frame 100-B. In the illustrated embodiment of the display frame 100-B the collectable package 108 has a blister 118-A that includes a foot 802. The foot 802 allows the package 108 to stand upright when placed on a flat surface. The front frame member 102-B includes a notch 312 dimensioned and configured to provide clearance for the foot 802 on the blister 118-A. In this way the planar portion 208 of the collectable 108 is supported by the display frame 100-B on both sides of the foot 802.

Figure 9:
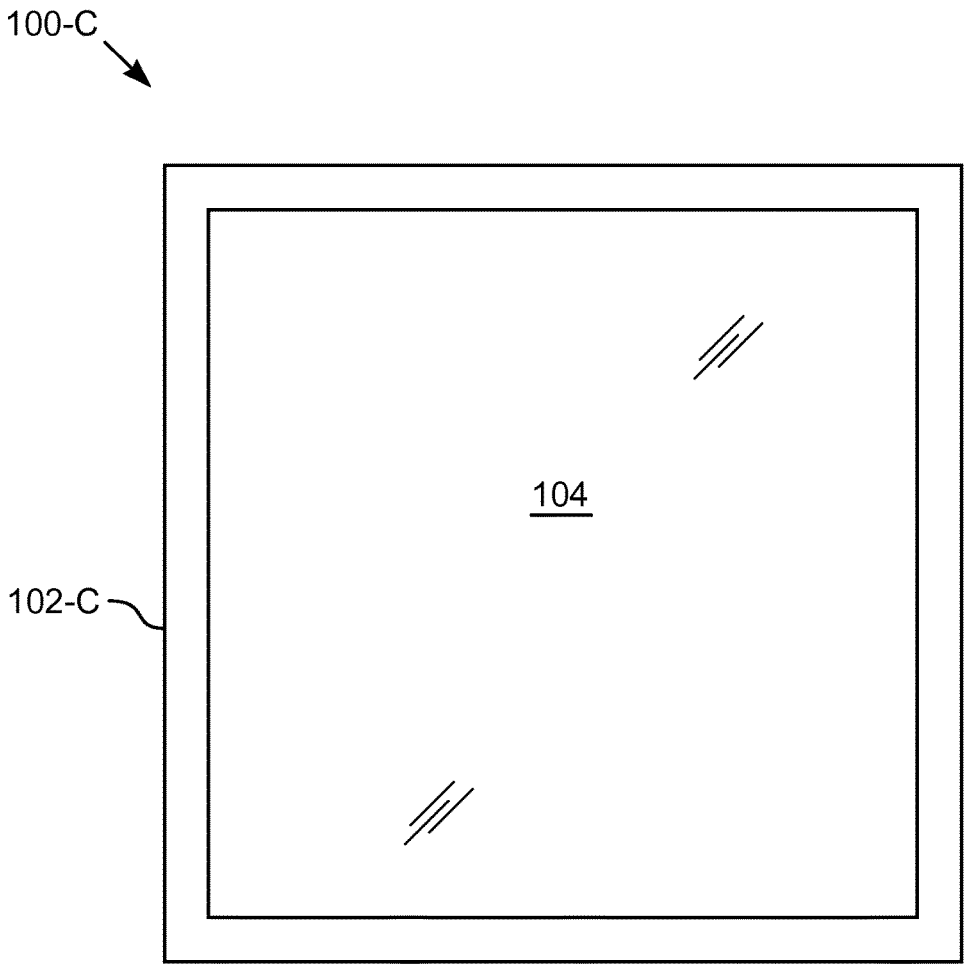
FIG. 9 is a plan view of the front of a third embodiment of a display frame.

FIG. 9 illustrates a plan view of the front of a third embodiment of a display frame 100-C dimensioned and configured to hold a collectable 108 such as a music album. The front frame member 102-C and the rear frame member (not illustrated) are substantially square so as to have the same proportions as the album being displayed.

In one such embodiment the display frame 100-C is configured to receive either a single or double record album. In various embodiments the display frame 100-C has one rear frame member 110 dimensioned to fit a single record album collectable 108 between the front and rear frame members 102, 110 and another rear frame member 110 dimensioned to fit a double record album collectable 108 between the front and rear frame members 102, 110. In yet another embodiment the rear frame member 110 is dimensioned to fit a double record album collectable 108 between the front and rear frame members 102, 110 and a spacer, such as cardboard, is positioned adjace the collectable 108 when a single record album collectable 108 is to be displayed.

In a similar embodiment the display frame 100-C is dimensioned and configured to hold a rectangular collectable 108 such as a poster. In one such embodiment two posters are positioned back-to-back in the display frame 100-C. The frame 100-C includes a hanger that allows the frame 100-C to be hung with either the front or the rear facing away from the wall. In this way the display can be alternated between the two collectables 108 by simply changing the orientation of the frame 100-C without having to open the frame 100-C and replace the collectable 108 with the one to be displayed.

For display frames 100-C that hold collectables 108 without a blister 118, such as albums and posters, the outside and inside notches 106, 218 are positioned at any convenient location, for example, at the top and/or bottom of the display frame 100-C.

Figure 10:
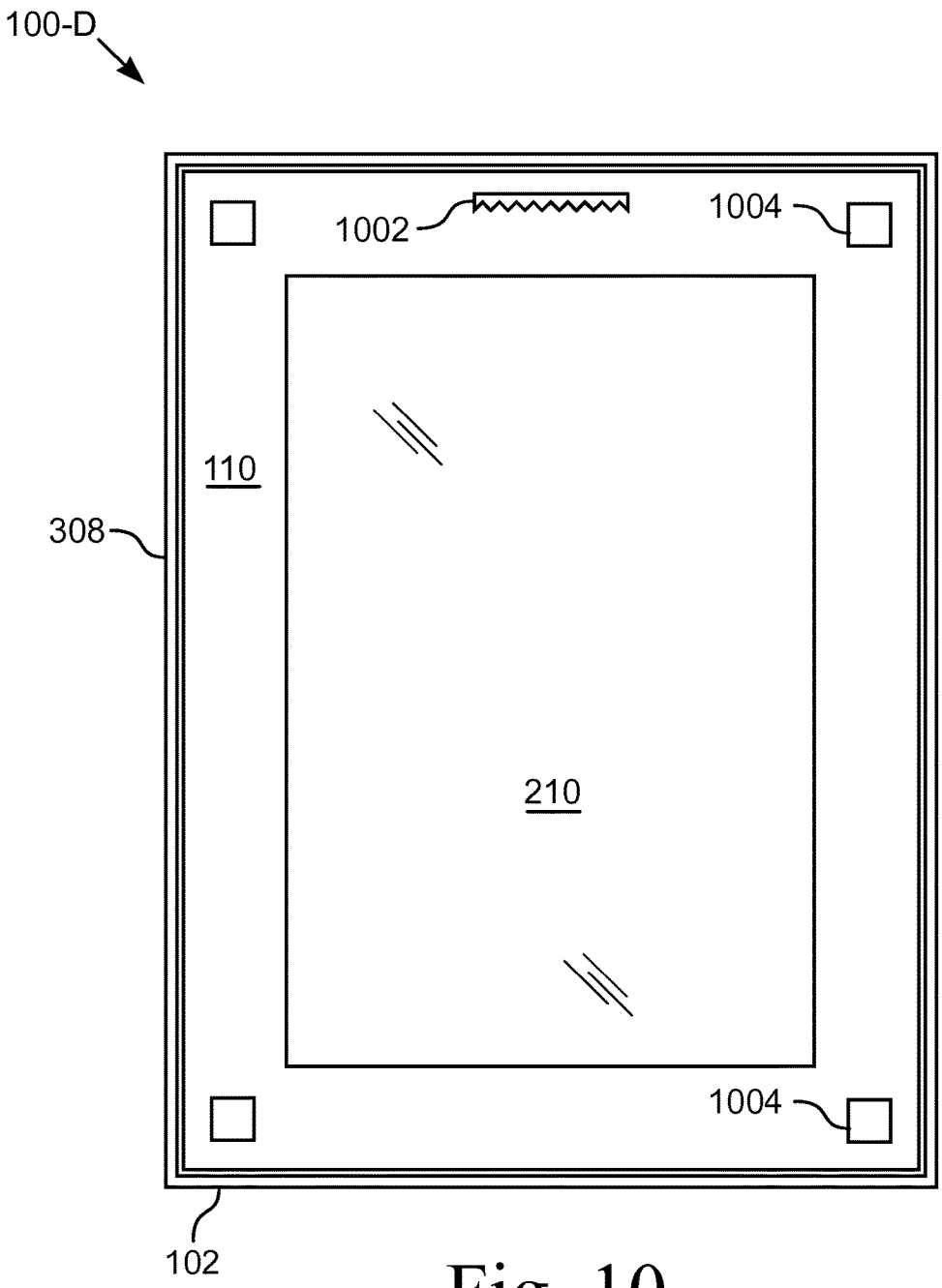
FIG. 10 is a plan view of the rear of a fourth embodiment of a display frame.

FIG. 10 illustrates a plan view of the rear of a fourth embodiment of a display frame 100-D. The rear surface 602 of the frame 100-D includes a hanger 1002 and spacers 1004. In various embodiments the hanger 1002 is configured to engage a nail or other protrusion on a wall. The spacers 1004, in various configurations, are spaced around the rear opening 210 or positioned on the opposite side of the opening 210 from the hanger 1002, that is, near the bottom of the rear surface 602. The spacers 1004 extend beyond the outer edge of the sidewalls 308 of the front frame member 102, thereby preventing the front and rear frame members 102, 110 from touching or contacting the wall on which the display frame 100-D is mounted.

Figure 11:
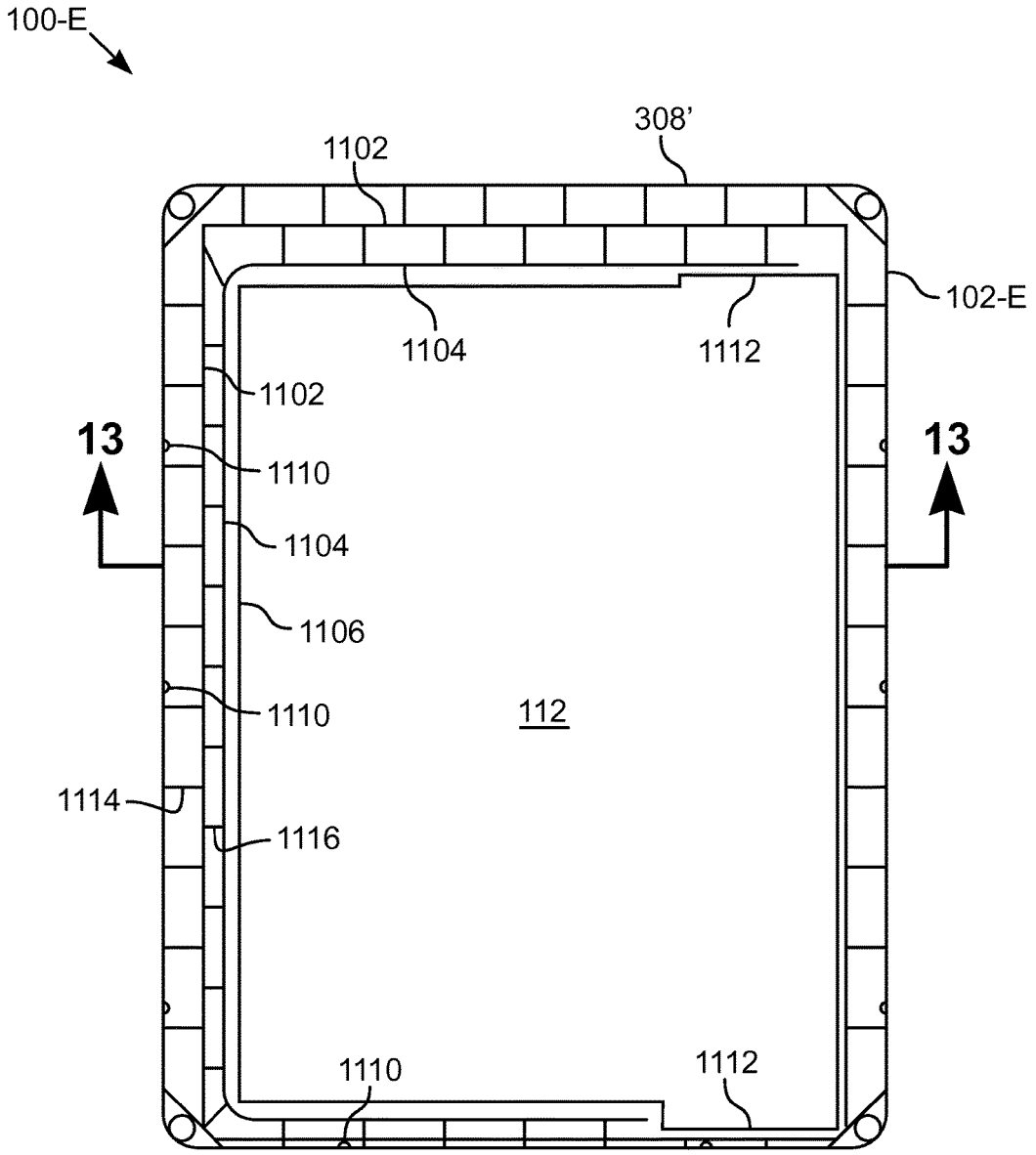
FIG. 11 is a rear plan view of a fifth embodiment of a front frame member for a display frame.
Figure 12:
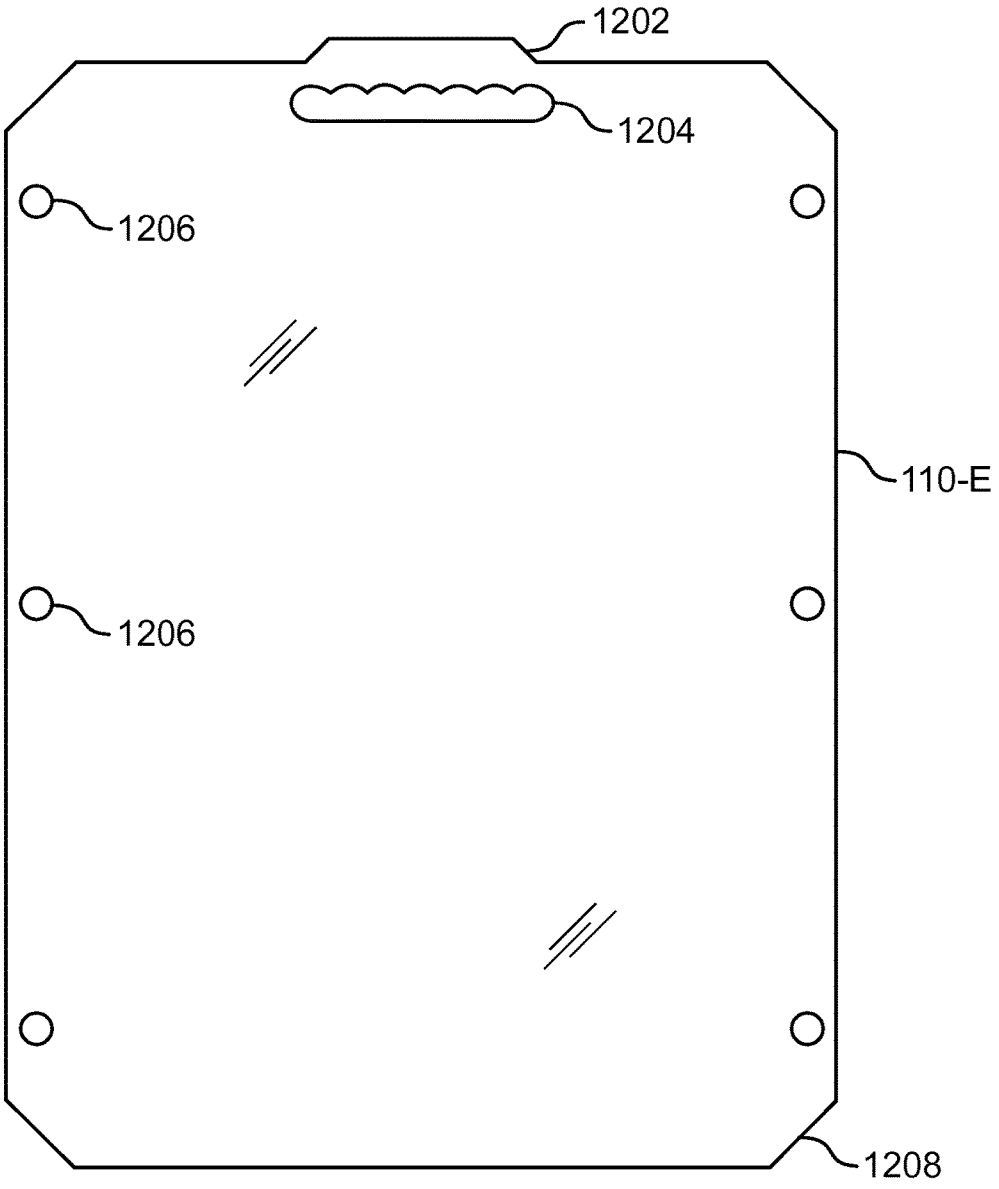
FIG. 12 is a rear plan view of an embodiment of a rear frame member for the display frame shown in FIG. 11.

FIG. 11 illustrates a rear plan view of a fifth embodiment of a front frame member 102-E for a display frame 100-E. FIG. 12 illustrates a rear plan view of an embodiment of a rear frame member 110-E for the display frame 100-E shown in FIG. 11. The display frame 100-E includes the front frame member 102-E and the rear frame member 110-E, which is recessed inside the sidewalls 308' of the front frame member 102-E when the rear frame member 110-E is latched in position.

The front frame member 102-E includes a front opening 112 through which a portion of the collectable 108 protrudes for display. The front frame member 102-E includes a pair of blister notches 1112 to accommodate a blister 118 that protrudes from the planar portion 208 of the collectable 108. Those skilled in the art will recognize that the notches 1112 are positioned and configured to accommodate the blister 118 for the collectable 108 to be displayed through the front opening 112 of the frame 100-E. In the illustrated embodiment the opening 112 defined by the lip 1106 that extends inward from the periphery of the front frame member 102-E. In another embodiment the display frame 100-E includes a front pane 104 that fits inside the front frame member 102-E, such as in the embodiment illustrated in FIGS. 1 & 2. In this embodiment the blister 118 protrudes from the frame 102-E with the front pane 104 protecting the non-blister, or planar, portion 208 of the collectable 108.

The rear frame member 110-E is a planar member that engages the front frame member 102-E. In the illustrated embodiment the rear frame member 110-E is a clear or transparent sheet that allows viewing of the collectable 108. In this regard the rear frame member 110-E performs the same function as the rear pane 204, such as in the embodiment illustrated in FIG. 2. The rear frame member 110-E includes an integral hanger 1204 formed in the material of the member 110-E. The hanger 1204 is an opening in the rear frame member 110-E that is positioned between the sidewall 308' and the frame support ribs 1102. In this way any nail or other support object engaging the hanger 1204 will not contact the collectable 108. In another embodiment a hanger 1002 is attached to the outer surface of the member 110-E. The hanger 1204, 1002 is configured with a horizontal adjustment to allow the frame 100 to be supported squarely when the center of gravity of the collectable 108 is not centered with the centerline of the frame 100.

The rear frame member 110-E has corners 1208 configured to engage the corners inside the front frame member 102-E. In the illustrated embodiment the rear frame member 110-E has diagonally cut corners 1208 that provide clearance for molded corner braces in the front frame member 102-E. Those skilled in the art will recognize that other configurations for mating with the front frame member 102-E can be used without departing from the spirit and scope of the present invention.

Figure 15:
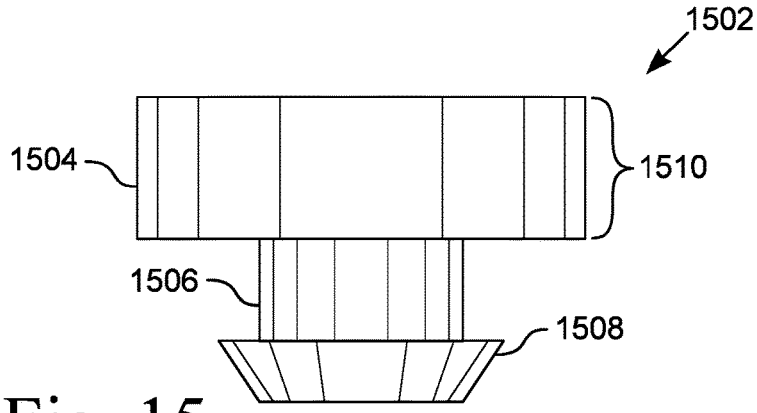
FIG. 15 is a side view of an embodiment of a spacer for the rear frame member shown in FIG. 12.

The rear frame member 110-E also includes openings 1206 that are spaced apart along the periphery of the sheet. These openings 1206 are configured to receive spacers 1502, such as illustrated in FIG. 15. The spacers 1502 are dimensioned and configured to extend rearward past the sidewalls 308' of the front frame member 102-E. In this way the collectable 108 is inserted in the display frame 100-E by first positioning the rear frame member 110-E on a flat surface with the spacers 1502 supporting the rear frame member 110-E. The collectable 108 is positioned on the rear frame member 110-E with the blister 108 or front facing upwards. The front frame member 102-E is then positioned over the collectable 108 such that the front frame member 102-E engages the rear frame member 110-E, thereby locking the frame members 102-A, 110-E together when downward pressure is applied to the front frame member 102-E.

Figure 13:
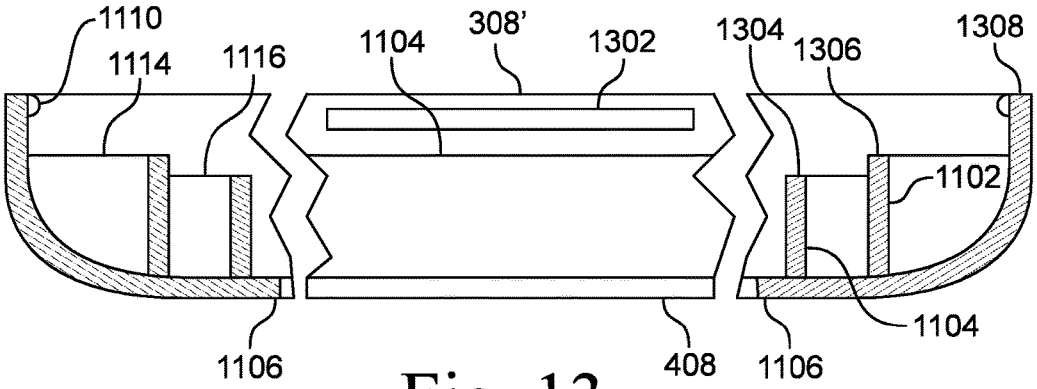
FIG. 13 is a partial cross-sectional view of the front frame member shown in FIG. 11.

FIG. 13 illustrates a partial cross-sectional view of the front frame member 102-E shown in FIG. 11. FIG. 13 illustrates the inside top of the front frame member 102-E, that is, the end of the member 102-E that is at the top of the display frame 100-E when it is mounted on a wall or other vertical support. The top sidewall 308' has a slot 1302 spaced slightly below the rearmost edge 1308 of the sidewall 308'. The slot 1302 is sized and configured to receive the protrusion or tab 1202 on the rear frame member 110-E. The tab 1202 securely supports the front frame member 102-E relative to the rear frame member 110-E both in the front-to-back and the side-to-side directions. The hanger 1204 positioned adjacent the tab 1202 orients the display frame 100-E with the tab 1202 and the slot 1302 at the top of the display frame 100-E when the frame 100-E is hung on a wall or otherwise supported by the hanger 1202.

The front frame member 102-E includes frame support ribs 1102 and collectable support ribs 1104. The frame support ribs 1102 have a rear end 1306 that is spaced a distance inside the front frame member 102-E from the rearmost edge 1308 of the sidewall 308'. The distance between the rear end 1306 of the frame support ribs 1102 and the detents 1110 adjacent the rearmost edge 1308 of the sidewall 308' is sufficient to receive the thickness of the rear frame member 110-E such that the member 110-E is wedged between the detents 1110 and the rear end 1306 of the frame support ribs 1102.

The collectable support ribs 1104 have a rear end 1304 that is spaced a distance inside the front frame member 102-E from the rearmost edge 1306 of the frame support ribs 1102. Frame support ribs 1102 are first members, and the displayed rearmost edge 1306 is a first ledge. Collectable support ribs 1104 are second members, and the displayed rear end 1304 is a second ledge. The distance between the rear end 1304 of the collectable support ribs 1104 and the rear end 1306 of the frame support ribs 1102 is the space in which the planar portion 208 of the collectable 108 fits. With the rear frame member 110-E resting against the rear end 1306 of the frame support ribs 1102, the planar portion 208 of the collectable 108 is supported between the rear frame member 110-E and the rear end 1304 of the collectable support ribs 1104. In various embodiments one or both of the resilient materials 224, 226 are attached to the collectable support ribs 1104 and/or rear frame member 110-E to clamp and cushion the collectable 108 in the display frame 100-E.

Between the sidewalls 308' of the front frame member 102-E and the frame support ribs 1102 are a plurality of first support webs 1114. Between the frame support ribs 1102 and the collectable support ribs 1104 are a plurality of second support webs 1116. The first and second support webs 1114, 1116 provide structural integrity for the front frame member 102-E, which, in the illustrated embodiment, is a molded plastic assembly. Those skilled in the art will recognize that the number, configuration, and placement of the webs 1114, 1116 will vary without departing from the spirit and scope of the present invention.

The illustrated embodiment of the display frame 100-E has a latching mechanism that includes the cooperating tab 1202 and slot 1302 and the cooperating detents 1110 and rear frame member 110-E. The front frame member 102-E includes a series of spaced detents or protrusions 1110 extending inward from the inside of the sidewalls 308' adjacent the rearmost edge 1308 of the sidewall 308'. The detents 1110 are positioned along the sides of the front frame member 102-E and the bottom of the member 102-E, where the bottom is opposite the top where the slot 1302 is located. The detents 1110 extend inward a sufficient distance that when the tab 1202 of the rear frame member 110-E is inserted into the slot 1302 and the rear frame member 110-E is then pushed into the front frame member 102-E against the frame support ribs 1102, the detents 1110 engage the outer corner or edge of the rear frame member 110-E, thereby securing the rear frame member 110-E inside the front frame member 102-E.

Figure 14:
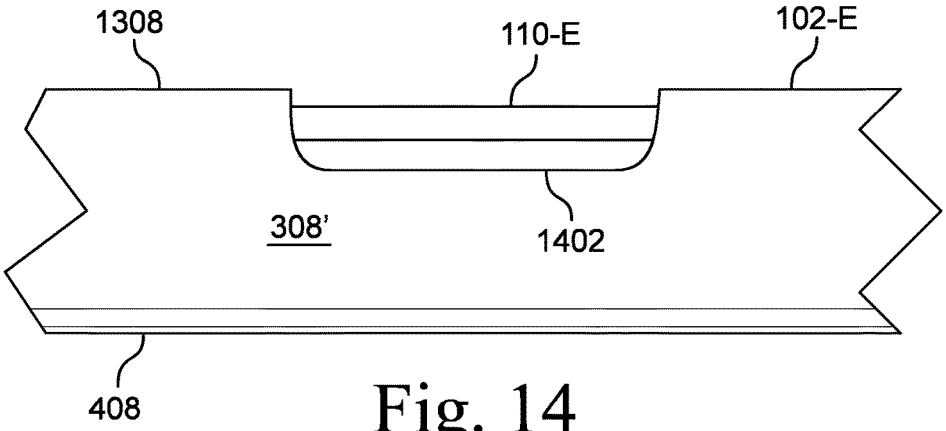
FIG. 14 is a partial view of the bottom of the display frame shown in FIG. 11.

FIG. 14 illustrates a partial view of the bottom of the display frame 100-E shown in FIG. 11. The bottom of the frame 100-E is in reference to the position of the frame 100-E when it is mounted on a wall, such as when it is suspended from the hanger 1204. The bottom sidewall 308' of the front frame member 102-E has a finger notch 1402 that allows a user to access the edge of the rear frame member 110-E in order to bias the lower edge of the rear frame member 110-E away from the front of the front frame member 102-E to disengage the member 110-E from the detents 1110 in the front frame member 102-E. In this way the rear frame member 110-E is unlatched from the front frame member 102-E, thereby allowing the insertion or removal of the collectable 108.

FIG. 15 illustrates a side view of an embodiment of a spacer 1502 for the rear frame member 110-E. The spacer 1502 includes a body 1504, a shaft 1506, and a keeper 1508. The body 1504 has a thickness 1510 sufficient to extend from the rearmost surface of the rear frame member 110-E to beyond the rearmost edge 1308 of the sidewall 308'. The shaft 1506 is cylindrical with a diameter dimensioned to fit into an opening 1206 in the rear frame member 110-E. The keeper 1508 in the illustrated embodiment is resilient with a wedge or truncated conical shape that compresses to fit into the opening 1206 and expand to keep the spacer 1502 secured to the rear frame member 110-E. The spacer 1502 in one embodiment is resilient such that the body 1504 provides cushioning between the rear frame member 110-E and the wall to which the display frame 100-E is hung.

The display frame 100 includes various functions. The function of accommodating a blister 118 of the packaging of a collectable 108 is implemented, in one embodiment, by the front opening 114 in the front pane 104, such as illustrated in FIGS. 1 and 2. In another embodiment the function of accommodating a blister 118 of the packaging of a collectable 108 is implemented by one or more blister notches 312, 1112 formed in the edge of the opening 112 of the front frame member 102.

The function of supporting the collectable 108 is implemented, in one embodiment, by the resilient material 216, 224 protruding from the rear and front panes 204, 104, respectively. In this way the collectable 108 is evenly supported, thereby preventing sagging or other damage to the collectable 108 from being displayed vertically. In another embodiment the function of supporting the collectable 108 is implemented by the front pane 104 positioned adjacent the flange extending from the sides of the blister 118. In this way the front pane 104 provides support to the flange and prevents the blister 118 from being pulled off or separating from the planar section 208 of the collectable 108.

The function of protecting the surface of the collectable 108 is implemented, in one embodiment, by the front and rear panes 104, 204. The front and rear panes 104 allow the display frame 100 to be handled while preventing direct contact with the planar surface 208 of the collectable 108. In this way the planar surface 208 of the collectable 108 is protected from finger prints or being otherwise marked or damaged.

The function of clamping the collectable 108 in the display frame 100 is implemented, in one embodiment, by the front and rear panes 104, 204 being forced against the front and rear surfaces of the planar portion 208 of the collectable 108. In such an embodiment the clamp includes the front and rear panes 104, 204 as jaws for clamping the collectable 108. In another embodiment the function of clamping is implemented by the clamp that includes the resilient material 224 on the front pane 104 and the resilient material 216 on the rear pane 204 as jaws for clamping the collectable 108 near its peripheral edge, such as illustrated in FIG. 7. The resilient material 224, 226 is a cushion that prevents damage to the collectable 108 by the clamp. In yet another embodiment the function of clamping is implemented by the clamp that includes the collectable support ribs 1104 and the rear frame member 110-E as jaws for clamping the collectable 108 near its peripheral edge while also providing support to the rear of the collectable 108 by the rear frame member 110-E. In one such embodiment, the resilient material 224, 226 is attached to the ribs 1104 and rear member 110-E, respectively, as cushions that prevent damage to the collectable 108 by the clamp.

The function of securing the front and rear frame members together is implemented by a latching mechanism, which, in one embodiment, includes the magnets 304 and metal objects 212 attached to the front and rear frame members 102, 110. In another embodiment the function of securing the front and rear frame members 102-E, 110-E together is implemented with the latching mechanism that includes the tab 1202 engaging the slot 1302 and the detents 1110 engaging the rear frame member 110-E. In yet another embodiment, the function of securing the front and rear frame members 102-E, 110-E together is implemented with the latching mechanism that includes the tab 1202 engaging the slot 1302 and the magnetic assembly that includes magnets 304 and metal objects 212.

The function of separating the front and rear frame members 102, 110 is implemented, in one embodiment, by the outside and inside notches 106, 218 that provide opposing lips 402, 604 that can be pushed apart to break the magnetic bond from the magnets 304, such as illustrated in FIGS. 3-6. In another embodiment the function of separating the front and rear frame members 102-E, 110-E is implemented with the finger notch 1402 in the bottom of the front frame member 102-E, such as illustrated in FIG. 14.

In another embodiment the function of separating the front and rear frame members 102, 110 is implemented by a pull tab or opening, such as the inside notch 218, in the rear frame member 110. The pull tab is attached to the rear frame member 110 and allows the rear frame member 110 to be pulled away from the front frame member 102. In such an embodiment the outside notch 106 is not necessary and the sidewalls 308 are smooth without any openings or notches.

The function of supporting the rear frame member laterally is implemented, in one embodiment, by the sidewalls 308 of the front frame member 102. The rear frame member 110 is dimensioned to fit inside the sidewalls 308 of the front frame member 102. The latching mechanism, such as the magnets 304 and metal objects 212 or the tab 1202 and slot 1302 with the detents 1110, secure the frame members 102, 110 front to back and the sidewalls 308, 308' prevent the rear frame member 110 from being displaced laterally.

The function of hiding the seam between the front and rear frame members 102, 110 is implemented, in one embodiment, by the sidewalls 308 that extend flush with or slightly beyond the rear surface 602 of the rear frame member 110.

From the foregoing description, it will be recognized by those skilled in the art that a display frame 100 has been provided. The display frame 100 has a front frame member 102, a rear frame member 110, a clamp, and a latch.

The front frame member 102 has a front surface 408 that surrounds an opening 112 and sidewalls 308, 308' that extend around the periphery of the front frame member 102. The front frame member 102 allows viewing of the collectable 108 from the front. In one embodiment the front frame 110 is used with a transparent front pane 104 configured to cooperate with the front of the collectable 108. For collectables 108 that have a blister or bubble 118, the front frame member 102 includes notches 312, 1112 that provide clearance for the blister 118, and, for those embodiments with a front pane 104, the pane 104 includes an opening or cutout 114 that allows the blister 118 to protrude through the pane 104.

The rear frame member 110 fits into the front frame member 102. The rear frame member 110 allows viewing of the collectable 108 from the rear. In one embodiment the rear frame member 110-A includes an opening 210 with a transparent rear pane 204. In another embodiment the rear frame member 110-E is a sheet with a transparent portion.

The clamp has members that secure the collectable 108 between the frame members 102, 110. In one embodiment the resilient material 224, 226 are the members that clamp and cushion the collectable 108. In various embodiments the resilient material 224, 226 is attached to the front and rear panes 104, 204 or the collectable support ribs 1104 and the rear frame member 110-E. In another embodiment the collectable support ribs 1104 and the rear frame member 110-E are the members that clamp the collectable 108. In yet another embodiment the front and rear panes 104, 204 are the members that clamp.

The latch, in one embodiment, includes the magnets 304 and metal objects 212 that are attached to the front and rear frame members 102, 110. In another embodiment the latch includes the detents 1110 and the rear frame member 110-E. In one embodiment the latch includes the tab 1202 and slot 1302.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for displaying a collectable, said apparatus comprising:

a first frame, said first frame includes a first face, a sidewall, first ribs, and second ribs;

said first face includes a first opening in said first face, said sidewall extends a first distance rearward from a periphery of said first face, said sidewall includes detents extending inward from said sidewall;

said first ribs extend a second distance rearward from said first face, said second distance is less than said first distance, said first ribs are displaced inward from said sidewall;

said second ribs extend a third distance rearward from said first face, said third distance is less than said second distance, said second ribs are displaced inward from said first ribs;

a second frame, said second frame is a pane, said sidewall defines a perimeter of said pane;

wherein said second frame is secured between said detents, an inner surface of said sidewall, and a rear end of said first ribs; and support webs, said support webs connecting said first ribs to said second ribs, said support webs extending away from first face at no greater than said second distance, said support webs are perpendicular to said first face.

2. The apparatus of claim 1, wherein said second distance is less than a distance of said detents from first face, and wherein a difference between said second distance and said distance of said detents from said first face is the same as a thickness of said second frame.

3. The apparatus of claim 1, wherein said second frame is transparent.

4. The apparatus of claim 1, wherein said detents include opposing pairs, and wherein a distance between said opposing pairs is less than a width of said second frame.

5. The apparatus of claim 1, wherein said second ribs, said first ribs, and said second frame are configured to restrict an outer perimeter section portion of a collectable, said outer perimeter section is a planar portion of said collectable.

6. The apparatus of claim 5, further comprising said collectable, wherein said collectable includes a blister portion, said first opening is configured to define a perimeter of said blister portion.

7. The apparatus of claim 1, further comprising a resilient material, said resilient material is flat, wherein a perimeter of said resilient material is defined by an inner surface of said first ribs, said resilient material is between said second frame and said second ribs, and said resilient material does not extend into said first opening in said first face.

8. The apparatus of claim 1, wherein said first and second ribs are perpendicular to said first face.

9. The apparatus of claim 1, wherein said first ribs are located on at least two opposing sides across said first opening.

10. The apparatus of claim 1, wherein said second ribs are located on a least two opposing sides across said first opening.

11. The apparatus of claim 1, further comprising said collectable, wherein a predetermined gap is defined by a distance between said second frame and a rear end of said second ribs, wherein said predetermined gap is greater than a thickness of peripheral flat portions of said collectable.

12. An apparatus for displaying a collectable, said apparatus comprising:

a frame, said frame including a first face, a sidewall, first ribs, and second ribs;

said first face includes an opening;

said sidewall defines a first distance from said first face, said first ribs define a second distance from said first face, said second ribs define a third distance from said first face, said first distance is greater than said second distance, said second distance is greater than said third distance;

said first ribs are between said second ribs and sidewall;

a pane, said pane is transparent, wherein an inner surface of said sidewall defines a perimeter of said pane;

wherein said pane is secured by said inner surface of said sidewall from moving parallel to said first face, wherein said pane is secured by detents extending inward from said second ribs from moving away from said first face, and wherein said pane is secured by a rear end of said first ribs from moving toward said front face;

a gap, wherein said gap is defined by an open space between said pane and a rear end of said second ribs, said gap has a constant distance; and first support webs and second support webs;

wherein said first support webs connect said sidewall to said first ribs, and wherein said first support webs extend away from first face at no greater than said second distance; and wherein said second support webs connect said first ribs to said second ribs, and wherein said second support webs extend away from said first face at no greater than said third distance.

* * * * *